US006647900B1

(12) United States Patent
Kopish

(10) Patent No.: US 6,647,900 B1
(45) **Date of Patent: *Nov. 18, 2003**

(54) FOLDING TRAINING TABLE WITH WIRE MANAGER PIVOTABLY MOUNTED TO AND BETWEEN A PAIR OF LEGS

(75) Inventor: Andrew J. Kopish, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 1 day.

This patent is subject to a terminal disclaimer.

(21) Appl. No.: 09/972,141

(22) Filed: Oct. 5, 2001

Related U.S. Application Data

(60) Provisional application No. 60/238,861, filed on Oct. 6, 2000.

(51) Int. Cl.[7] ..... A47B 3/02

(52) U.S. Cl. ..... 108/50.02; 312/223.6; 108/115

(58) Field of Search ..... 108/50.01, 50.02, 108/115; 312/128, 223.6, 223.1

(56) References Cited

U.S. PATENT DOCUMENTS 127,484 A 6/1872 Hirsh (List continued on next page.)

FOREIGN PATENT DOCUMENTS

CA 561882 8/1958

(List continued on next page.)

OTHER PUBLICATIONS

Falcon, M.A.T.S. Multiple Application Table System Catalog.

(List continued on next page.)

*Primary Examiner*—Jose V. Chen
(74) *Attorney, Agent, or Firm*—Boyle, Fredrickson, Newholm, Stein & Gratz, S.C.

(57) ABSTRACT

A folding table or desk includes a table top, a pair of spaced apart legs, and a wire management structure pivotably mounted between the legs. The wire management structure includes a front panel assembly having an opening, and an access member is pivotably mounted to the front panel assembly for movement between an open position, a closed position and a collapsed position. The front panel assembly can be folded against the underside of the table top and the access member can be pivoted to its collapsed position relative to the front panel assembly, and the legs are foldable over the wire management structure to provide a compact envelope for the folded components of the table assembly. The front panel assembly includes a cross brace member which is engageable with the legs when the wire management structure is in its operative extended position, to impart rigidity to the table assembly. Wires or cables are fed through openings in the table top into an internal cavity defined by the wire management structure, for engagement with power or communication receptacles located within the internal cavity. The front panel assembly is pivotably mounted between the legs via a hinge-type pivot connection interposed between each leg and the wire management structure, for isolating the wire management structure from the table top and forming the legs and wire management structure into a subassembly separate from the table top.

20 Claims, 9 Drawing Sheets

U.S. PATENT DOCUMENTS

| | | | | |
|---|---|---|---|---|
| 155,999 | A | | 10/1874 | Valley |
| 165,951 | A | | 7/1875 | Root |
| 290,932 | A | | 12/1883 | Richardson |
| 964,996 | A | | 12/1910 | Matthes |
| 1,177,639 | A | | 4/1916 | Lessord |
| 1,903,954 | A | | 4/1933 | Blumenthal |
| 2,509,546 | A | | 5/1950 | Welk et al. |
| 3,643,907 | A | | 2/1972 | Ham |
| 3,805,711 | A | | 4/1974 | Lakso |
| 3,991,687 | A | | 11/1976 | Burr |
| 3,993,005 | A | | 11/1976 | Burr |
| 4,010,699 | A | | 3/1977 | Lakso |
| 4,214,725 | A | | 7/1980 | Eberle |
| D261,341 | S | | 10/1981 | Eberle |
| D263,189 | S | | 3/1982 | Beals |
| 4,444,124 | A | | 4/1984 | Burr |
| 4,789,122 | A | | 12/1988 | Gutgsell |
| 4,827,850 | A | | 5/1989 | Diffrient |
| 4,827,851 | A | | 5/1989 | Diffrient |
| 4,838,180 | A | | 6/1989 | Gutgsell |
| 4,875,418 | A | | 10/1989 | Moeckl et al. |
| 4,986,195 | A | | 1/1991 | Diffrient |
| D314,299 | S | | 2/1991 | Diffrient |
| D322,373 | S | | 12/1991 | Gutgsell |
| D322,729 | S | | 12/1991 | Diffrient |
| D324,615 | S | | 3/1992 | Diffrient |
| D329,554 | S | | 9/1992 | Diffrient |
| 5,144,896 | A | | 9/1992 | Fortsch |
| 5,154,126 | A | | 10/1992 | Newhouse et al. |
| D333,058 | S | | 2/1993 | Diffrient |
| D335,983 | S | | 6/1993 | Gutgsell |
| 5,220,871 | A | | 6/1993 | Grund et al. |
| 5,231,562 | A | | 7/1993 | Pierce et al. |
| 5,237,935 | A | | 8/1993 | Newhouse et al. |
| 5,279,233 | A | | 1/1994 | Cox |
| 5,337,657 | A | | 8/1994 | Diffrient |
| 5,345,881 | A | | 9/1994 | Loescher |
| 5,354,027 | A | | 10/1994 | Cox |
| 5,357,874 | A | | 10/1994 | Palmer |
| 5,365,861 | A | | 11/1994 | Gutgsell |
| D355,317 | S | | 2/1995 | Gutgsell |
| 5,390,610 | A | | 2/1995 | Gutgsell |
| 5,427,341 | A | | 6/1995 | Gutgsell |
| D360,325 | S | | 7/1995 | Gutgsell |
| 5,490,467 | A | | 2/1996 | Diffrient |
| 5,507,204 | A | | 4/1996 | Diffrient |
| 5,533,457 | A | | 7/1996 | Cox |
| D372,812 | S | | 8/1996 | Graziano et al. |
| 5,560,302 | A | | 10/1996 | Diffrient et al. |
| 5,568,773 | A | | 10/1996 | Hung |
| 5,640,912 | A | | 6/1997 | Diffrient |
| 5,715,760 | A | | 2/1998 | Frascaroli et al. |
| D391,841 | S | | 3/1998 | Loescher |
| 5,749,121 | A | | 5/1998 | Loescher |
| 5,752,449 | A | | 5/1998 | Simon et al. |
| 5,769,514 | A | | 6/1998 | Brown et al. |
| 5,927,214 | A | * | 7/1999 | Schwartz et al. |
| 5,934,201 | A | * | 8/1999 | Diffrient |
| 5,947,628 | A | | 9/1999 | Hansen |
| 5,957,062 | A | | 9/1999 | Cox et al. |
| 5,971,508 | A | | 10/1999 | Diemen et al. |
| 5,971,509 | A | | 10/1999 | Diemen et al. |
| 6,003,447 | A | | 12/1999 | Cox et al. |
| 6,082,838 | A | * | 7/2000 | Bissu-Palombo |
| 6,170,407 | B1 | * | 1/2001 | Hayward |
| 6,202,567 | B1 | | 3/2001 | Funk et al. |
| 6,314,892 | B1 | * | 11/2001 | Favini |
| 6,336,414 | B1 | * | 1/2002 | Stewart et al. |
| 6,415,723 | B1 | * | 7/2002 | Kopish et al. |

FOREIGN PATENT DOCUMENTS

| | | | |
|---|---|---|---|
| CA | 754441 | | 3/1967 |
| CH | 632654 | | 10/1982 |
| DE | 212711 | | 8/1909 |
| DE | 390509 | | 2/1924 |
| DE | 161012 | | 6/1933 |
| DE | 16493 | | 3/1989 |
| EP | 0131673 | | 10/1987 |
| EP | 0572770 | | 6/1992 |
| FR | 393495 | | 12/1908 |
| FR | 1004929 | | 4/1952 |
| FR | 2624176 | | 6/1989 |
| GB | 2207601 | | 6/1886 |
| GB | 14530 | | 7/1894 |
| GB | 483470 | | 4/1938 |
| GB | 2130877 | | 10/1982 |
| GB | 2323273 A | * | 9/1998 |
| IT | 356303 | | 9/1937 |
| WO | WO90/03132 | | 4/1990 |

OTHER PUBLICATIONS

Falcon, M.A.T.S. Multiple Aplication Table System Brochure, 1996.

Bretford, Folding Training Tables Catalog.

Bretford, Fixed Leg Training Tables Catalog.

Bretford, Transtable Brochure, 1996.

Howe, Tutor Training Tables Brochure.

"Folding Tables", Contract Design Magazine, pp. 48–50, Sep. 1995.

Howe, Tutor Systems Furniture Catalog, pp. 205–231.

Bretford Power Systems 101 Brochure.

Bretford Presentation Environments Price List, Jan. 1, 1998.

Vecta Table Cable Installation Instructions.

Vecta Table Cable Brochure.

Versteel Powerlink Catalog.

Falcon, M.A.T.S.II Multiple Application Table System Brochure, 1999, Falcon Products, Inc. 9387 Dielman Industrial Drive, Sait Louis, Missouri 63132.

"The Perfect Table", M.A.T.S.II Brochure, undated, Falcon Products, Inc. Dielman Industrial Drive, Saint Louis, Missouri 63132.

PowerComm Table System Brochure, KI–00132/PP1294, 1994, KI, 1330 Bellevue Street, Green Bay, Wisconsin 54302.

* cited by examiner

FOLDING TRAINING TABLE WITH WIRE MANAGER PIVOTABLY MOUNTED TO AND BETWEEN A PAIR OF LEGS

CROSS-REFERENCE TO RELATED APPLICATIONS

This application claims the benefit of U.S. Provisional Application Serial No. 60/238,861, filed Oct. 6, 2000.

BACKGROUND AND SUMMARY OF THE INVENTION

This invention pertains to a table assembly, and more particularly to a table assembly incorporating a foldable leg arrangement and including a wire management arrangement for accommodating wires and cables associated with equipment supported on a table top forming a part of the table assembly.

In applications in which electrified equipment is supported on a table top, it is known to provide a housing below the table top for accommodating cables or wires associated with equipment supported on the table top, and for mounting electrical and/or data receptacles for providing power and communication to connectors associated with such cables or wires. One such structure is shown in co-pending application Ser. No. 08/258,429 filed Jun. 10, 1994, the disclosure of which is hereby incorporated by reference. This application discloses a table or desk top having a power and communication housing fixedly mounted to its underside. Cables or wires extend through one or more openings in the table or desk top, and a movable cover is selectively engageable with the table or desk top for providing access to such wires or cables for connection to power and communication receptacles interconnected with the power and communication housing. The power and communication housing extends between a pair of fixed legs which are mounted to the table or desk top for supporting the table or desk top above a supporting surface such as a floor. While this type of table or desk structure functions extremely well in permanent installations, it is not well suited for installations in which folding of the table or desk is required for accommodating movement of the table or desk from one location to another and/or storage of the table or desk.

A folding table or desk is disclosed in Diffrient U.S. Pat. No. 5,337,657, which shows a wire management housing to which of the table or desk top is pivotably mounted for movement between an operative horizontal position and an inoperative folded position. The wire management housing is located between a pair of spaced legs, and each leg is pivotably mounted to an end of the wire management housing for movement about a vertical pivot axis between an operative position and a folded position. The legs are oriented such that when the table top is folded downwardly, the lower ends of the legs extend below the lower edge of the table top. While this table or desk is usable in installations requiring folding of the table components for movement or storage, the extension of the legs beyond the lower edge of the table top takes up an excessive amount of storage space. Further, the table cannot support itself when folded, and thus must be engaged with a supporting structure such as a wall or the like to prevent the folded table from tipping over.

It is an object of the present invention to provide a folding table assembly which incorporates a table top, a folding leg arrangement mounted to the table top, and a wire management structure, which is well suited for receiving cables or wires and which provides components which fold to a compact condition for movement and storage of the table assembly. It is a further object of the invention to provide such a table assembly in which the wire management structure functions to impart rigidity to the leg structure when the leg structure is in an operative extended position. A further object of the invention is to provide such a table assembly in which the wire management structure is adapted to be folded toward the underside of the table top when not in use, and in which the legs are foldable over the wire management structure. A still further object of the invention is to provide such a table assembly which is capable of supporting itself on a supporting surface, such as a floor, when the components of the table assembly are in a folded position. Yet another object of the invention is to provide such a table assembly in which the leg structure and the wire management structure are self-supporting without connection to the table top, to facilitate removal and replacement of the table top. Yet another object of the invention is to provide such a table assembly in which wires or cables can be positioned within a recess in each leg and placed within the internal cavity of the wire management structure without having to thread wires or cables through a passage in either the legs or the wire management structure. Yet another object of the invention is to provide such a table assembly which is relatively simple in its components and manufacture, yet which provides highly satisfactory accommodation of wires or cables and movement of its components between folded and unfolded positions.

The invention generally includes a table top defining an upper surface and an underside, in combination with leg structure and a wire management housing or structure mounted below the table top. The leg structure is preferably in the form of a pair of spaced apart legs, each of which is pivotable toward each other to an inoperative folded position and away from each other toward an operative extended position. The wire management structure is mounted to and between the pair of legs, and is pivotable between an operative extended position and an inoperative folded position toward the underside of the table top.

Each leg includes a wire management recess extending throughout at least a portion of its length, and a cover is movably mounted adjacent the recess for movement between an open position and a closed position. The wire management structure includes an access member movable between an open position and a closed position for selectively providing access to an internal cavity defined by the wire management structure and selectively preventing access to the internal cavity. The legs and the wire management structure are oriented relative to each other such that the access member and the cover can each be in its open position at the same time. In this manner, wires or cables can be laid into the wire management recess in the leg and into the internal cavity of the wire management structure without having to thread such wires or cables into or through passages. When wires or cables are positioned in this manner within the wire management recess of the leg and the internal cavity of the wire management structure, the cover and the access member can subsequently be closed to maintain the wires or cables within the wire management recess and the internal cavity.

In accordance with another aspect of the invention, the wire management structure includes a front panel assembly movably mounted below the table top. A pivot connection is provided between the front panel assembly and each leg, such that the front panel assembly is pivotably mounted to and between the legs without connection to the table top. The pivot connection provides movement of the wire management structure between its operative extended position and its inoperative folded position. In a preferred form, the pivot connection is in the form of a hinge which connects the wire management structure to each leg. A cross brace member is mounted to the front panel assembly at a location spaced from the pivot connection. The cross brace member is releasably engageable with the legs when the legs are in their operative extended positions, for bracing the legs against lateral movement and for preventing movement of each leg toward its inoperative folded position. The cross brace member braces the legs against lateral movement and imparts rigidity to the overall structure of the table assembly. The cross brace member includes a pair of spaced ends, and an extendible and retractable engagement member is mounted to each end of the cross brace member for engagement within a recess associated with one of the legs when the wire management structure and the legs are in their operative extended positions. The extendible and retractable engagement member is disengageable from the recess for enabling the wire management structure and the legs to be moved to their inoperative folded positions. The access member is movable between its open and closed positions by means of a pivot connection interposed between the access member and the cross brace member.

In accordance with another aspect of the invention, the movable access member is capable of movement between an open position and a closed position when the wire management structure is in its operative extended position, and is movable to a collapsed position when the wire management structure is in its inoperative folded position. In this manner, the access member provides selective access to the internal cavity of the wire management structure when the wire management structure is in its operative extended position, and movement of the access member to its collapsed position functions to reduce the volume of space occupied by the wire management structure when the wire management structure is in its inoperative folded position. The legs are foldable over the wire management structure when the access member is in its collapsed position, and the collapsibility of the wire management structure functions to reduce the overall space requirements for the legs and wire management structure when in their inoperative folded positions, to provide a compact overall package for the folded table assembly for providing ease of movement and storage. The access member is preferably pivotably mounted to the cross brace member, and engagement structure is interposed between the access member and the cross brace member for releasably maintaining the access member in its closed position and for accommodating movement of the access member to its open position and to its collapsed position.

The various features and aspects of the invention may be employed separately, and each provides advantages in construction, assembly or use of a table assembly or components of a table assembly. Alternatively, the features and aspects of the invention may be used in various subcombinations or all together, for providing additional enhancements and advantages in construction, assembly or use of a table assembly.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
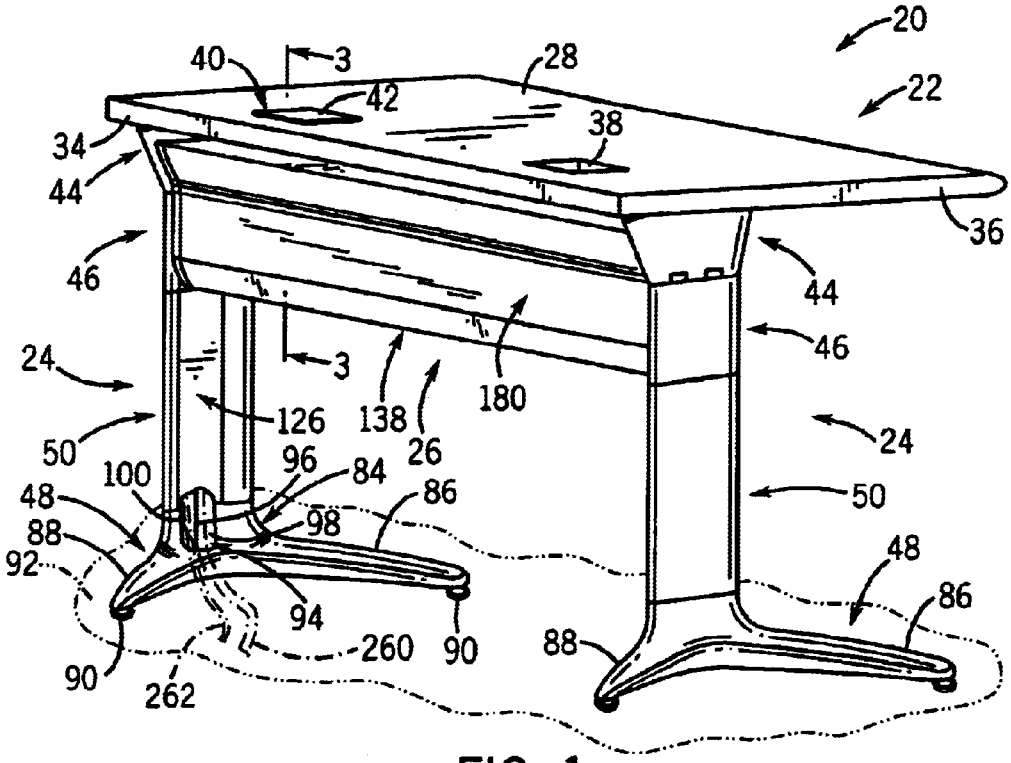
FIG. 1 is an isometric view of a table assembly constructed according to the invention, incorporating a table top, a pair of foldable legs and a wire management structure extending between the pair of legs.

With reference now to the drawing figures in which like reference numerals designate like parts throughout the description, a table assembly is indicated generally at 20 in FIG. 1. The table assembly 20 constructed according to the present invention generally includes a table top 22, a pair of mirror image foldable leg assemblies 24, and a wire management housing or structure 26 located between leg assemblies 24.

Referring to FIGS. 1–4, table top 22 includes an upper surface 28, an underside 30, front and rear edges 32, 34, respectively, and side edges 36 which extend between front and rear edges 32, 34, respectively. A pair of spaced openings 38 are formed in table top 22 toward its rear edge 34, extending between upper surface 28 and underside 30 of table top 22. A grommet assembly 40, including a movable cover 42, is mounted within each opening 38. Openings 38 and grommet assemblies 40 provide a passage through table top 22.

Each leg assembly 24 includes an upper stationary mounting section 44, a shoulder section 46, a foot 48 and an intermediate section 50 interposed between the lower end of shoulder section 46 and the upper end of foot 48.

Figure 12:
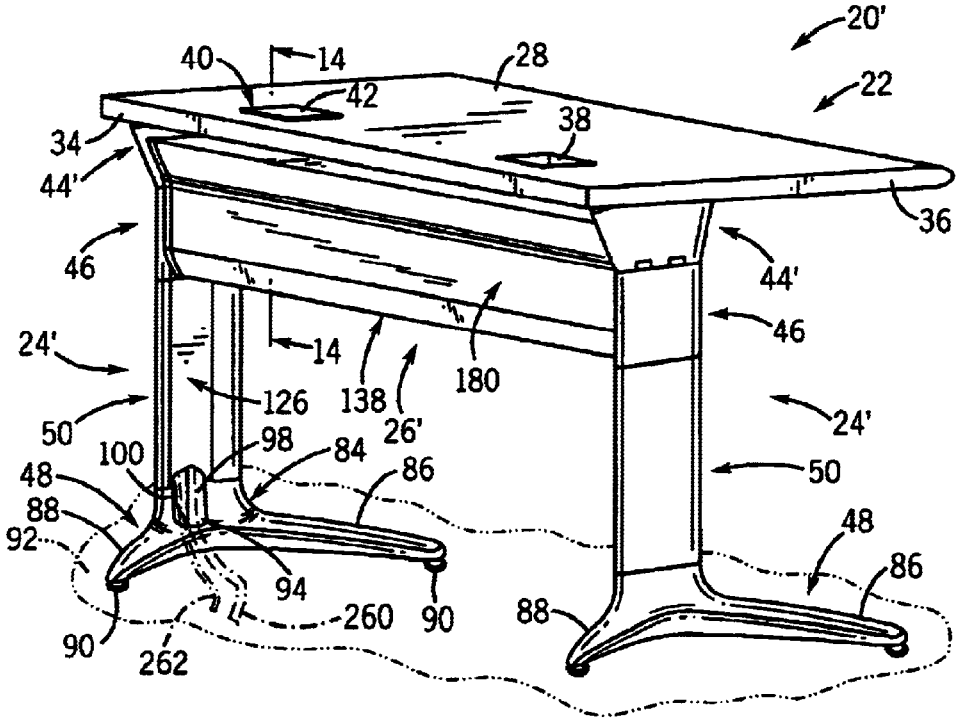
FIG. 12 is an isometric view showing an alternative construction of the table assembly constructed according to the invention.
Figure 13:
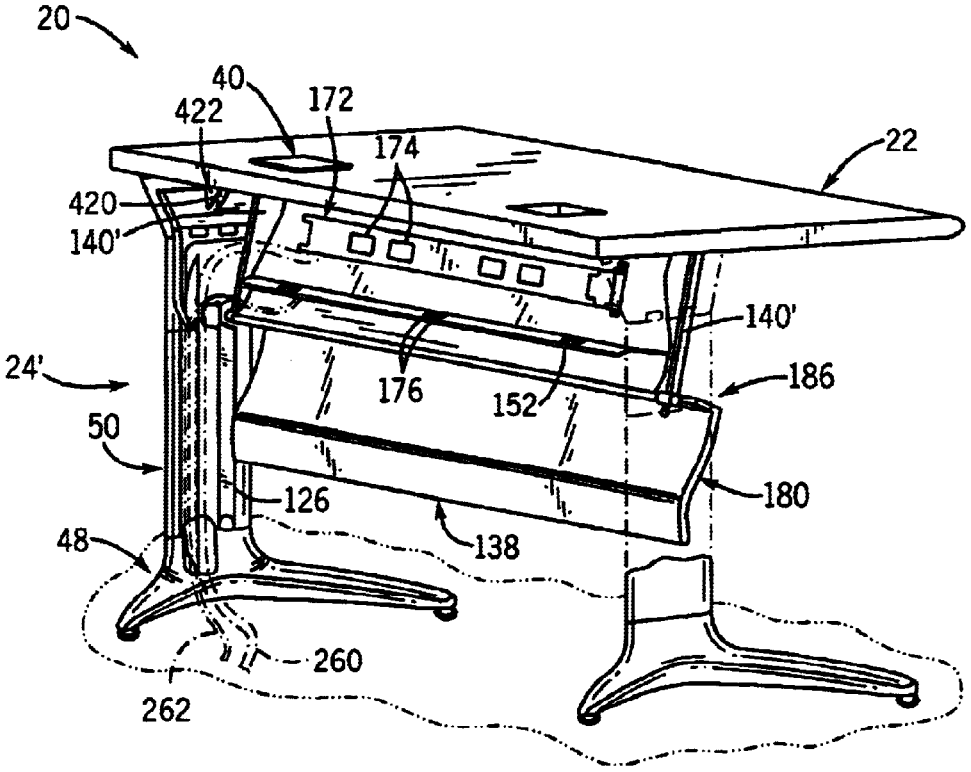
FIG. 13 is a view similar to FIG. 12, showing an access member of the wire management structure movable to an open position.

Upper mounting section 44 of each leg assembly 24 includes a rear section 52 and a forwardly extending arm 54 which define a coplanar upper surface 56 which is spaced below underside 30 of table top 22 so as to define a gap or space 58. Referring to FIG. 12, a pair of mounting bosses 60 extend between upper surface 56 and underside 30 of table top 22. Mounting bosses 60 are formed integrally with mounting section 44, and table top 22 engages the upper ends of mounting bosses 60. Each mounting boss 60 defines a passage, and a threaded fastener extends through the passage in each mounting boss 60 into engagement table top 22 for securing table top 22 to leg mounting section 44.

As shown in FIGS. 1–4, mounting section 44 is formed with a pair of reinforcing ribs 62 located below each mounting boss 60. A series of hinge knuckles 64 are formed at the lower end of rear section 52 of leg mounting section 44. Each hinge knuckle 64 defines an aligned horizontal passage, in a manner as is known. Mounting section 44 may be a cast metal member formed of a material such as aluminum, and the horizontal passages in hinge knuckles 64 are machined after casting to provide a smooth internal surface.

Shoulder section 46 of leg assembly 24 is formed with a recess 68 within which an axially extending separator wall 70 is formed. Separator wall 70 defines an upper end 72, and divides recess 68 into a front recessed area 74 and a rear recessed area 76. A reinforcing rib 78 is formed in recess 68 toward the lower end of shoulder section 46. A pair of hinge knuckles 80 are formed at the upper end of shoulder section 46, and are located in the spaces between hinge knuckles 64 of upper mounting section 44. Hinge knuckles 80 include horizontal passages in alignment with the horizontal passages of hinge knuckles 64, and a hinge pin extends into and through the aligned horizontal passages in hinge knuckles 64, 80 for providing pivoting movement of shoulder section 64 about a horizontal pivot axis parallel to and spaced below table top 22. Shoulder section 46 is preferably a cast metal member formed of a material such as aluminum, and again the passages in hinge knuckles 80 are machined after casting to provide a smooth internal surface.

Foot 48 of each leg assembly 24 includes a base section 84, a forward extension 86 which extends forwardly from base section 84 and a rearward extension 88 which extends rearwardly from base section 84. A glide 90 is mounted to the underside of the front end of forward extension 86. Similarly, a glide 90 is mounted to the underside of the rear end of rearward extension 88. Glides 90 engage a supporting surface 92, such as a floor, for spacing table top 22 above supporting surface 92. A recess 94 is formed in the inner surface of base section 84. An axial separating wall 96 is located within recess 94, and functions to divide recess 94 into a front recessed area 98 and a rear recessed area 100. Foot 48 is preferably a cast metal member formed of a material such as aluminum.

Figure 6:
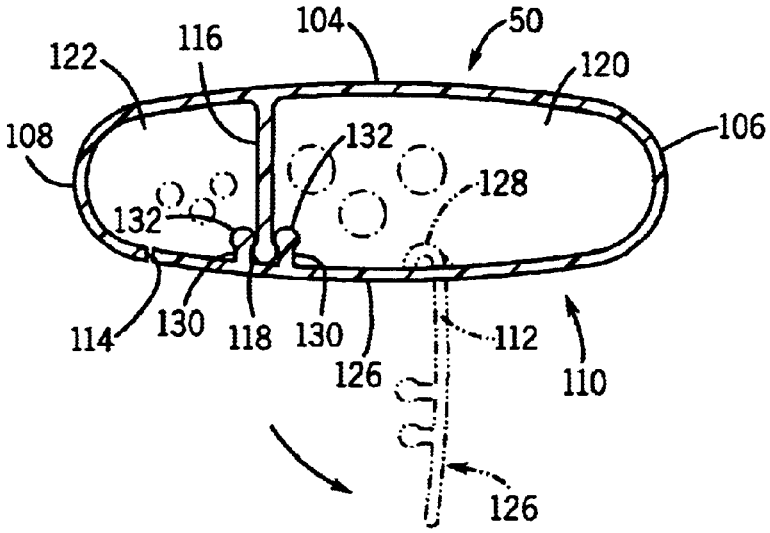
FIG. 6 is a view taken along line 6—6 of FIG. 3.

Referring to FIG. 6, intermediate section 50 of each leg assembly 24 includes an outer wall 104 which extends between an arcuate front wall 106 and an arcuate rear wall 108. Front wall 106 merges with a partial inner wall 110 which terminates in a rearward end 112. Rear wall 108 terminates in a forward end 114 spaced rearwardly from rearward end 112 of partial inner wall 110. An axial divider 116 extends inwardly from the inner surface of outer wall 104, and terminates in an inner end 118 which forms an engagement bead having a diameter slightly greater than the width of divider 116. Intermediate section 50 defines a front passage 120 and a rear passage 122 separated by divider 116. The open area between inner wall rearward end 112 and forward end 114 of rear wall 108 provides access to front and rear passages 120, 122, respectively. Intermediate section 50 is preferably an extruded metal member formed of a material such as aluminum When leg intermediate section 50 is mounted between shoulder section 46 and foot 48, divider 116 is in alignment with separating wall 96 formed within recess 94 of foot base section 84, and with separator wall 70 in shoulder section recess 68. In this manner, front passage 120 of intermediate section 50 is aligned with and extends between front recessed area 98 of foot 48 and front recessed area 74 of shoulder section 46, and rear passage 122 is aligned with and extends between rear recessed area 100 of foot 48 and rear recessed area 76 of shoulder section 46.

A cover 126 is pivotably mounted to intermediate section 50 by means of a pivot connection 128 interposed between a forward end of cover 126 and intermediate section 50 at rearward end 112 defined by inner wall 110. Cover 126 is pivotable at pivot connection 128 for movement about a vertical pivot axis between a closed position, as shown in solid lines in FIG. 6, and an open position as shown in phantom. Cover 126 defines a wall which extends between and fills the space defined by inner wall rearward end 112 and forward end 114 of rear wall 108 when cover 126 is in its closed position. A pair of engagement members 130 extend from the inner surface of cover 126, and each engagement member 130 defines a bead 132 at its outer end. Engagement members 130 are spaced apart a distance sufficient to enable bead 118 at the inner end of divider wall 116 to be received therebetween, and beads 132 of engagement members 130 engage bead 118 to releasably maintain cover 126 in its closed position. Cover 126 is movable to its open position by application of an outward pulling force on cover 126, which disengages beads 132 from bead 118 at the inner end of divider 116, to provide access to front and rear passages 120, 122, respectively. Cover 126 is placed in its closed position by application of an inward force on cover 126 to move cover 126 toward divider 116, and beads 132 pass over bead 118 at the inner end of divider 116 as cover 126 is pivoted toward its closed position, for releasably maintaining cover 126 in its closed position.

Referring to FIGS. 1–4, wire management structure 26 generally includes a front panel assembly 136 and an access member 138. In a manner to be explained, front panel assembly 136 is movable relative to table top 22 between an operative extended position and an inoperative folded position. Access member 138 is movable relative to front panel assembly 136 between an open position and a closed position when front panel assembly 136 is in its operative extended position, and is movable to a collapsed position when front panel assembly 136 is in its inoperative folded position.

Front panel assembly 136 includes a pair of end frame members 140, each of which defines an outer end mounted to a cross brace member 142. A wall 144 extends between end frame members 140. Wall 144 defines an inner end 146 spaced slightly below underside 30 of table top 22, and an outer end 148 spaced above cross brace member 142. A support wall 150 extends rearwardly from panel wall 144 at its outer end 148, and a mounting flange 152 extends from the rearward end of support wall 150.

Figure 3:
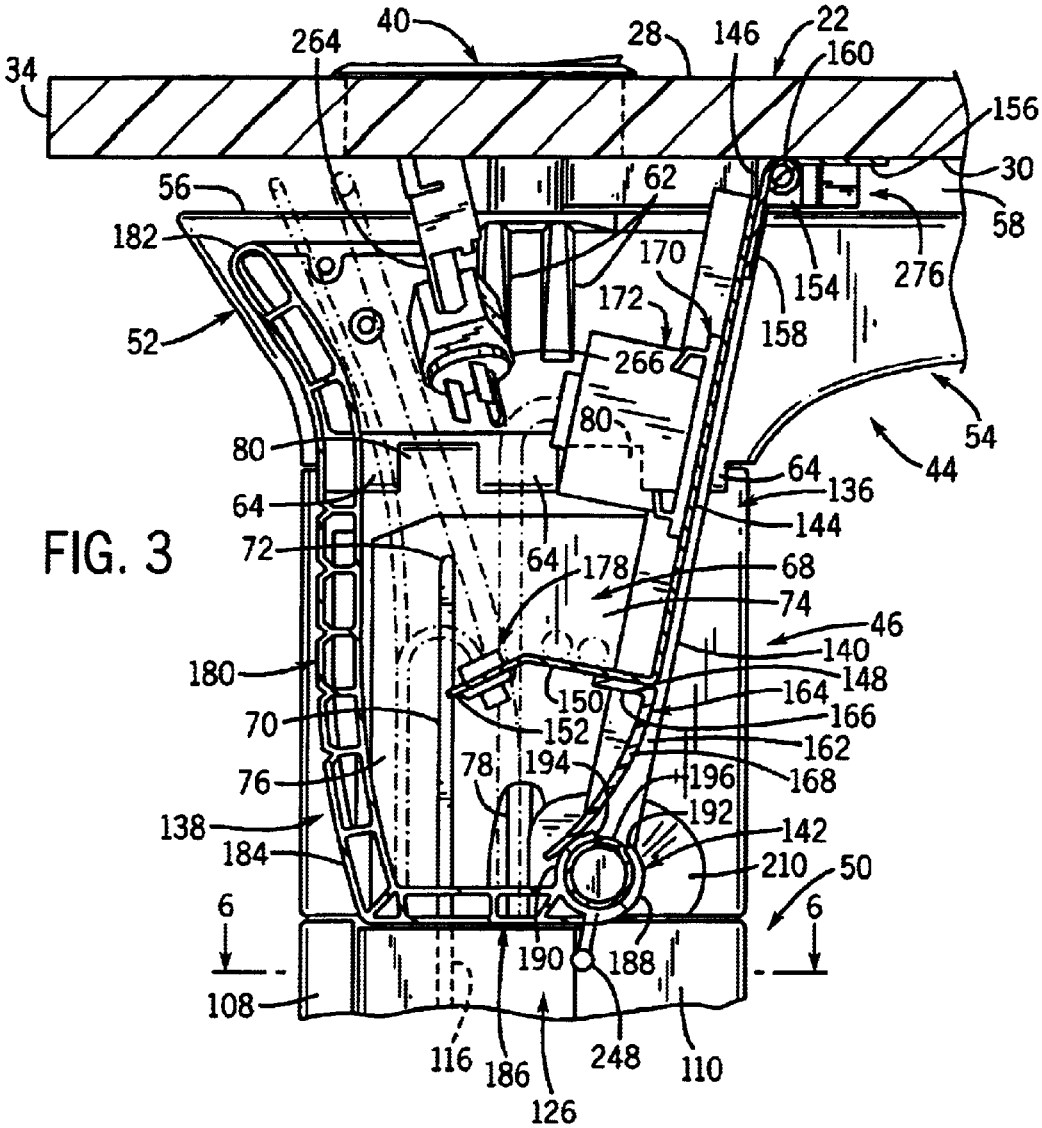
FIG. 3 is a partial section view taken along line 3—3 of FIG. 1.
Figure 11:
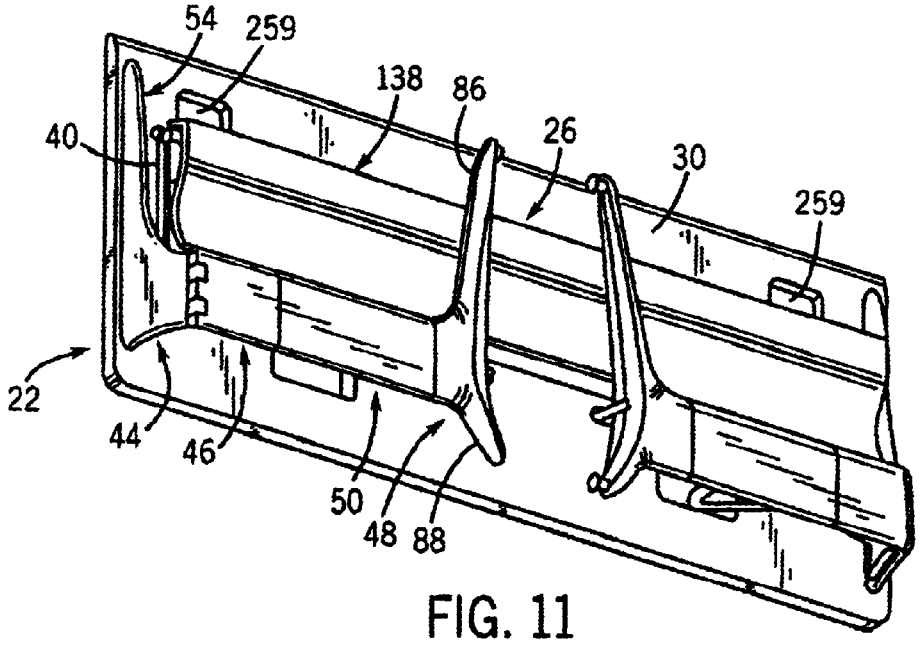
FIG. 11 is an isometric view illustrating both the wire management structure and the legs in their inoperative folded positions.

A pair of hinge assemblies 154 are interposed between table top 22 and front panel assembly 136. Each hinge assembly 154 includes a stationary leaf 156 mounted to underside 30 of table top 22, and a movable leaf 158 mounted to panel wall 144. A hinge pin 160 provides pivoting movement of leaf 158 relative to leaf 156, to thereby provide pivoting movement of front panel assembly 136 relative to table top 22. Front panel assembly 136 is pivotable about hinge pins 160 between an extended position, as shown in FIG. 3, and a folded position against underside 30 of table top 22, as shown in FIG. 11.

Outer end 148 of panel wall 144 is spaced from cross brace member 142, so as to define an access opening 162 therebetween. A resilient closure member 164 is placed within opening 162. Closure member 164 includes a mounting flange 166 secured to support wall 150 for mounting closure member 164 to panel wall 144, and a closure flap 168 extending downwardly from the front end of mounting flange 166. Closure flap 168 has a length greater than the height of opening 162, such that its lower end overlaps cross brace member 142 and is positioned inwardly thereof. Closure flap 168 functions to fill access opening 162 throughout the width of front panel assembly 136.

A mounting bracket 170 is secured to the inside surface of panel wall 144. An electrical receptacle assembly 172 is engaged with mounting bracket 170, and includes a series of power receptacles 174 along its length. Representatively, receptacle assembly 172 may be that such as is available from Group Dekko of Kendallville, Ind. under its Part No. 225453, or any other satisfactory electrification assembly known to those skilled in the art.

Mounting flange 152 at the outer end of support wall 150 is provided with a series of spaced openings 176. Each opening 176 is adapted to receive a conventional communication jack assembly 178 (FIG. 3).

Access member 138 includes a rear panel 180 defining an upper edge 182 and terminating in a lower end 184. A bottom panel 186 extends forwardly from lower end 184 of rear panel 180. Bottom panel 186 is formed integrally with a clamping structure which includes a front clamping member 188 and a rear clamping member 190. Front clamping member 188 extends tangentially in a forward direction from the lower surface of bottom panel 186, defining an arcuate shape terminating in an end 192. Rear clamping member 190 extends upwardly and forwardly from the upper surface of bottom panel 186, and cooperates with front clamping member 188 to form an arcuate shape defining a nearly circular cross-section. Rear clamping member 190 terminates in an end 194 spaced from end 192 of front clamping member 188. In a preferred form, access member 138 is an extruded member formed of a relatively lightweight material such as plastic or any other satisfactory material. The material of access member 138 making up front and rear clamping members 188, 190, respectively, is relatively rigid.

Cross brace member 142 is in the form of a tubular member defining an outward protrusion 196 along its length. Front and rear clamping members 188, 190 define an open internal passage within which cross brace member 142 is received, for providing pivotable mounting of access member 138 to cross brace member 142 about a pivot axis defined by the longitudinal axis of cross brace member 142. When access member 138 is in its closed position of FIG. 3, protrusion 196 of cross brace member 142 is located between end 192 of front clamping member 188 and end 194 of rear clamping member 190. Engagement of clamping member ends 192, 194 with protrusion 196 functions to releasably maintain access member 138 in its closed position. In this position, access member 138 cooperates with panel assembly 136 to define an internal cavity located below table top 22 and openings 38, and extending throughout the width of wire management structure 26 between leg assemblies 24.

Figure 2:
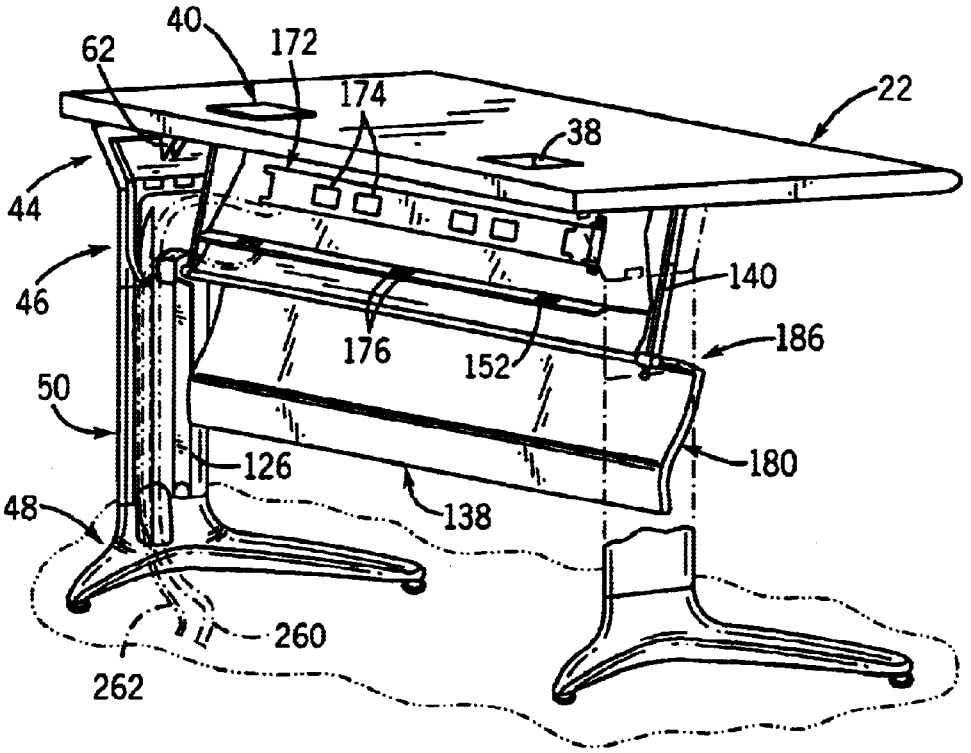
FIG. 2 is a view similar to FIG. 1, showing an access member of the wire management structure movable to an open position.

Access member 138 is movable relative to front panel assembly 136 between a closed position as shown in FIGS. 1 and 3, and an open position as shown in FIG. 2. To move access member 138 from its closed position to its open position, a user engages upper edge 182 of access member rear panel 180 below underside 30 of table top 22, and exerts a rearward and downward force on access member 138. Clamping members 188, 190 maintain engagement with cross brace member 142, and application of such a force to access member 138 results in end 192 of front clamping member 188 riding over protrusion 196, which functions to separate front clamping member 188 and rear clamping member 190. When it is desired to return access member 138 to its closed position, the user exerts an upward and forward force on access member 138 so as to return access member 138 to its closed position of FIGS. 1 and 3, in which protrusion 196 is again located between ends 192, 194 of front and rear clamping members 188, 190, respectively. Clamping members 188, 190 return to their original condition due to the resiliency of the material from which clamping members 188, 190 are formed, so as to again engage ends 192, 194 with protrusion 196 to maintain access member 138 in its closed position. Access member 138 can be repeatedly opened and closed in this manner, and clamping members 188, 190 remain operable to releasably maintain access member 138 in its closed position.

Figure 10:
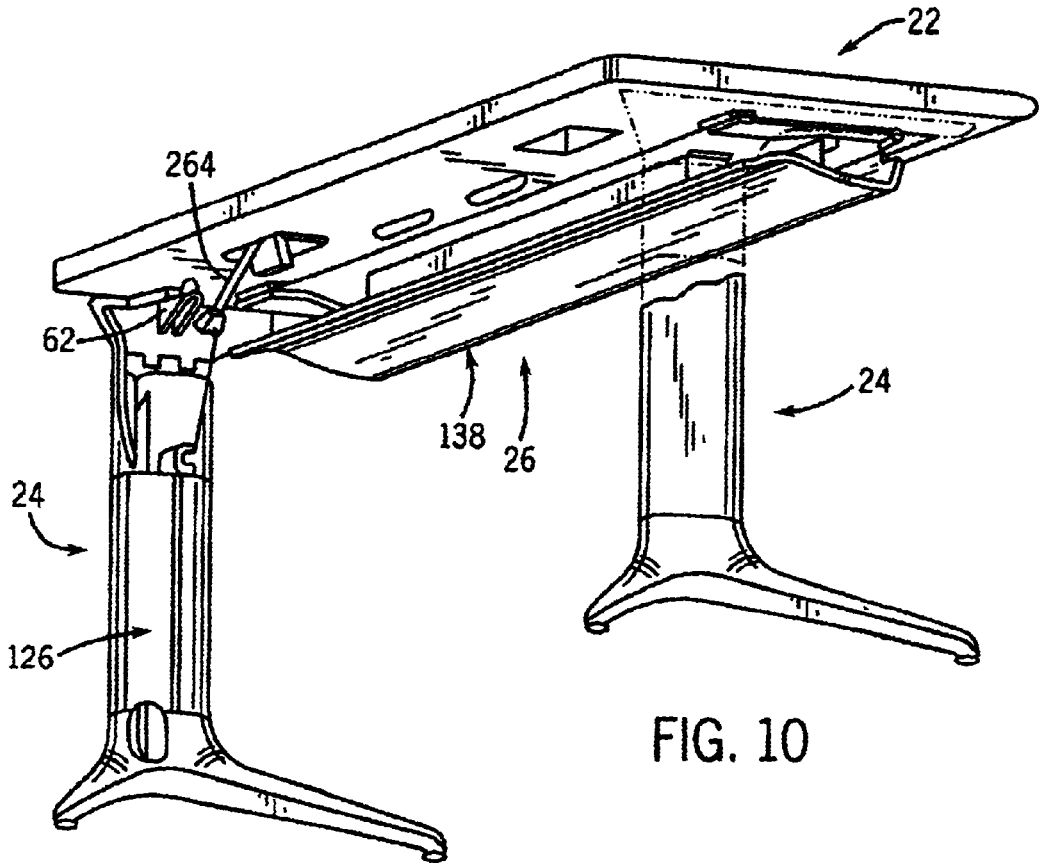
FIG. 10 is an isometric view of the underside of the table of FIG. 1, showing movement of the wire management structure to an inoperative position and the legs in an operative extended position.

Access member 138 can also be moved to a collapsed position, as shown in FIG. 10, when front panel assembly 136 is pivoted to its inoperative folded position against underside 30 of table top 22 by operation of hinge assemblies 154. Movement of access member 138 to its collapsed position of FIG. 10 is accomplished by exerting an upward force on access member 138 to fold access member 138 toward front panel assembly 136. When access member 138 is moved to its collapsed position, end 194 of rear clamping member 190 rides over protrusion 196 for moving clamping members 188, 190 apart from each other, in a manner similar to that described above with respect to movement of access member 138 toward its open position. When desired, access member 138 can subsequently be placed in its open position by exerting a force on access member 138 away from front panel assembly 136, to again result in placement of protrusion 196 between ends 192, 194 of front and rear clamping members 188, 190, respectively.

Figure 7:
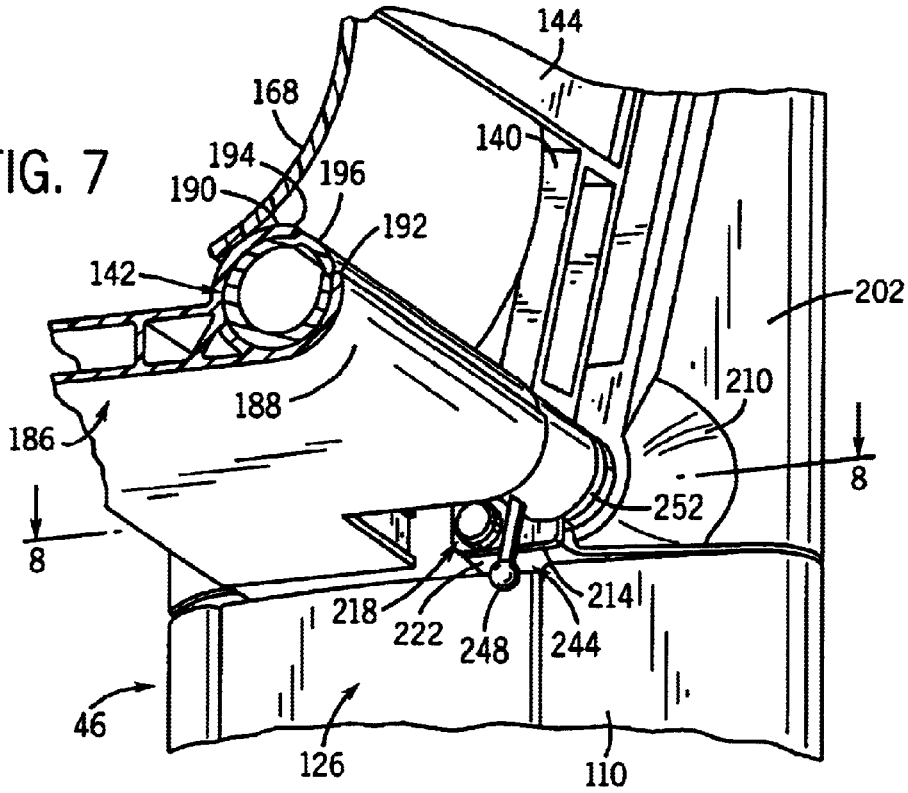
FIG. 7 is a partial isometric view illustrating a lower portion of the wire management structure and of FIG. 3 and its interconnection with a leg of the table assembly.
Figure 8:
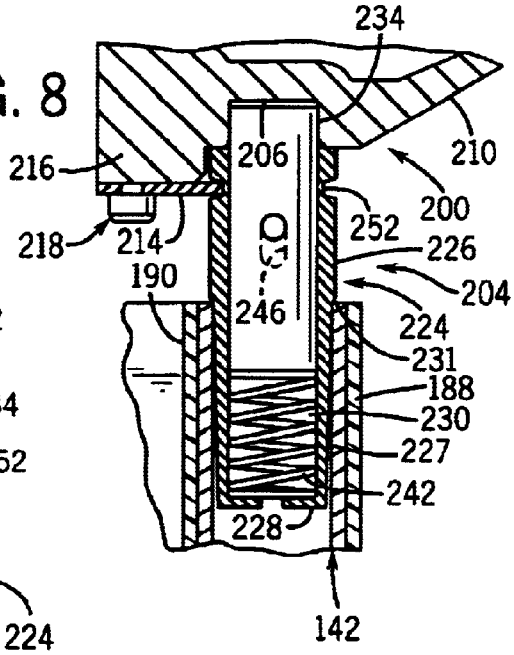
FIG. 8 is a partial section view taken along line 8—8 of FIG. 7, showing engagement of a cross brace member forming a part of the wire management structure within a receiver associated with the leg.
Figure 9:
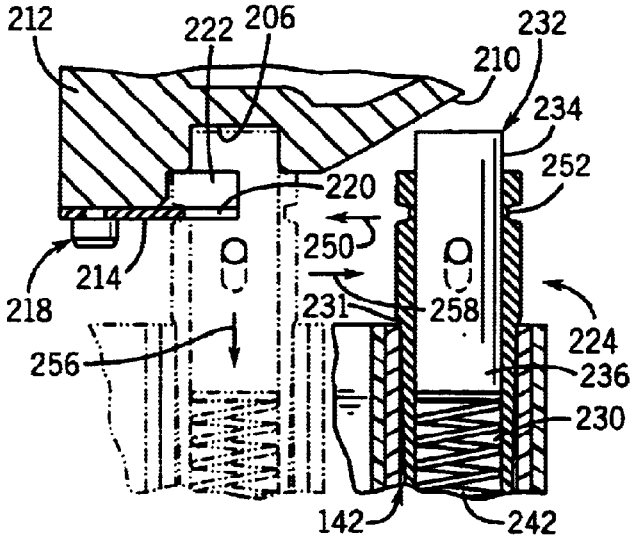
FIG. 9 is a view similar to FIG. 8, showing disengagement of the cross brace member of the wire management structure from the leg.

When wire management structure 26 is in its operative extended position and each leg 24 is in its operative extended position, as shown in FIGS. 1–5, cross brace member 142 is engaged with leg assemblies 24 to impart rigidity to the supporting structure of table assembly 20 and to prevent legs 24 from moving to their folded position. FIGS. 7–9 illustrate a releasable engagement arrangement interposed between each end of cross brace member 142 and each leg assembly 24, which enables cross brace member 142 to be selectively engaged with and disengaged from one of leg assemblies 24, for imparting rigidity to table assembly 20 in operation and for enabling the components of table assembly 20 to be folded for transport or storage.

Referring to FIGS. 7–9, the releasable engagement arrangement includes receiving structure 200 provided on the inner wall, shown at 202, of leg shoulder section 46, in combination with an extendible and retractable engagement assembly 204 mounted to each end of cross brace member 142. Receiving structure 200 includes a recess 206. A ramp 210 is formed on inner wall 202 forwardly of recess 206, and a mounting boss 212 is located rearwardly of recess 206. Mounting boss 212 defines a threaded passage, and a retainer plate 214 is engaged with the end of mounting boss 212. A screw 218 extends into the threaded passage in boss 212, for mounting retainer plate 214. An arcuate notch 220 is formed in the forward edge of retainer plate 214. A lower wall 222 engages the bottom edge of retainer plate 214 below notch 220.

Extendible and retractable engagement assembly 204 includes a cylindrical member 224 mounted within the open end of cross brace member 142. Cylindrical member 224 defines an outer side wall 226 and an inner side wall 227 terminating in an open end wall 228, which cooperate to define an outwardly opening internal cavity 230. A shoulder 231 is located between outer side wall 226 and inner side wall 227. Cylindrical member 224 is mounted to cross brace member 142 by inserting inner side wall 227 into the open end of cross brace member 142 until shoulder 231 engages the end of cross brace member 142, as shown in FIG. 9. Longitudinal slots are formed in inner side wall 227 so as to enable inner side wall 227 to deflect inwardly during insertion into cross brace member 142, such that cylindrical member 224 is mounted to cross brace member 142 with a friction fit engagement.

A plunger member 232 is engaged within internal cavity 230, and includes a head portion 234 and an inner portion 236 received within the passage of cylindrical member 224. Head portion 234 is configured to be received within recess 206. A spring 242 is received within cylindrical member internal passage 230. The inner end of spring 242 engages end wall 228 of cylindrical member 224, and the outer end of spring 242 bears against the inner end of plunger member 232.

Plunger member 232 includes a finger pull member 244 defining an inner portion engaged within a passage formed in plunger inner portion 236, and an outer portion extending outwardly therefrom through a slot 246 formed in side wall 226 of cylindrical member 224. An engagement knob 248 is located at the outer end of finger pull member 244 for facilitating engagement therewith by a user. Spring 242 functions to bias plunger member 232 outwardly toward a position in which finger pull member 244 engages the outer end of slot 246.

FIG. 9 illustrates cross brace member 142 positioned forwardly of receiving structure 200. In order to engage cross brace member 142 between leg assemblies 24, the user moves front panel assembly 136 toward its operative extended position of FIG. 3, in the direction of arrow 250. As front panel assembly 136 approaches its operative extended position, plunger head portion 234 engages ramp 210, which functions to move plunger member 232 inwardly into internal cavity 230 of cylindrical member 224. This results in inward movement of finger pull member 244 within slot 246 against the force of spring 242. When front panel assembly 136 is in its operative extended position, head portion 234 of plunger member 232 is positioned over recess 206 and spring 242 urges plunger member 232 outwardly to engage head portion 234 within recess 206, as shown in FIG. 8. Notch 220 in retainer plate 214 engages plunger member 232 at a groove 252 defined in the outer surface of head portion 234, to ensure that cross brace member 142 cannot be moved beyond a position in which head portion 234 of plunger member 232 is positioned in alignment with recess 206.

The structure of head portion 234 and recess 206, in combination with engagement of retainer plate 214 within groove 252 functions to impart stability to table assembly 20 upon application of lateral transverse forces to table assembly 20 through table top 22. Further, such engagement of cross brace member 142 maintains leg assemblies 24 in their operative extended positions.

To enable wire management structure 26 to be moved to its inoperative folded position of FIG. 10, the user grasps the outer end of finger pull member 244 using knob 248, and exerts an inward force in the direction of arrow 256 (FIG. 9) for withdrawing head portion 234 of plunger member 232 out of recess 206, as shown in phantom in FIG. 9. This results in movement of finger pull member 244 within slot 246 against the force of spring 242. Once head portion 234 has cleared recess 206, the user exerts an upward and forward force on wire management structure 26, and moves front panel assembly 136 to its inoperative folded position of FIG. 10.

It can thus be appreciated that extendible and retractable engagement assembly 204 provides automatic engagement of cross brace member 142 with leg assemblies 24 when wire management structure 26 is moved to its operative extended position, and provides a rigid releasable engagement structure for bracing leg assemblies 24 against lateral movement.

In operation, once wire management structure 26 is in its inoperative folded position of FIG. 10 and access member 138 is in its collapsed position, the user folds leg assemblies 24 toward each other over wire management structure 26 as shown in FIG. 11 to prepare table assembly 20 for storage or transport. When wire management structure 26 is in its inoperative folded position and access member 138 is in its collapsed position, the space occupied by wire management structure 28 is significantly less than that occupied by wire management structure 26 when in its extended operative position of FIG. 3. When folded in this manner, wire management structure 26 occupies a space less than that defined between underside 30 of table top 22 and the hinge axis of leg assemblies 24, defined by the hinge pin received within hinge knuckles 64, 80. The user is then able to lift and transport table assembly 10 using hand grip recesses 259 formed in underside 30 of table top 22.

Referring to FIG. 12, rear edge 34 of table top 22 and the rearward end of foot rearward extension 88 are substantially coplanar. With this construction, table assembly 20 can be supported on supporting surface 92 by table top rear edge 34 and the end of foot rearward extension 88, which significantly facilitates storage and handling of table assembly 20 when folded.

Referring to FIGS. 1–3, a power supply cable 260 and a communication cable 262 are routed through one of leg assemblies 24 and into the internal cavity of wire management structure 26 by first moving access member 138 of wire management structure 26 to its open position and moving leg cover 126 to its open position. Wire management structure 26 and cover 126 are configured and arranged such that access member 138 and cover 126 can both be in the open position at the same time, to provide lay-in capability for power supply cable 260 and communication cable 262. Power supply cable 260 is positioned within front passage 120 of leg intermediate section 50, and communication cable 262 is placed within rear passage 122 of leg intermediate section 50. Divider 116 maintains power cables 260 and communication cables 262 apart from each other, to prevent RF interference and to ensure proper operation. Recess 68 in leg shoulder section 46 is in communication with the internal cavity wire management structure 26, such that cables 260, 262 extend directly from leg assembly 24 into the internal cavity of wire management structure 26. Once cables 260, 262 are engaged within leg passages 120, 122, respectively, as described, cover 126 is moved to its closed position as shown in solid lines in FIG. 6 to maintain cables 260, 262 in position and to provide an aesthetically pleasing external appearance of leg assembly 24. Power supply cable 260 is engaged with receptacle assembly 172 for providing electrical power thereto in a manner as is known, and communication cable 262 is interconnected with a communication jack 178 in a manner as is known. A number of power supply cables 260 and communication cables 262 can be routed through leg assembly 24 in this manner, for providing a desired number of electrical power circuits and communication receptacles for each table assembly 20.

Cables or wires extending from equipment supported by upper surface 28 of table top 22 are routed through grommet assemblies 40 and into the internal cavity defined by wire management structure 26, for engagement with power receptacles 174 and communication jacks 178. The internal cavity of wire management structure 26 provides sufficient space for receiving any excess amount of such wires or cables in order to prevent cluttering of the top of table top 22. Referring to FIG. 3, a power cord extending from equipment supported by table top 22 is shown at 264, including a plug 266 for engagement with one of receptacles 174.

Figure 5:
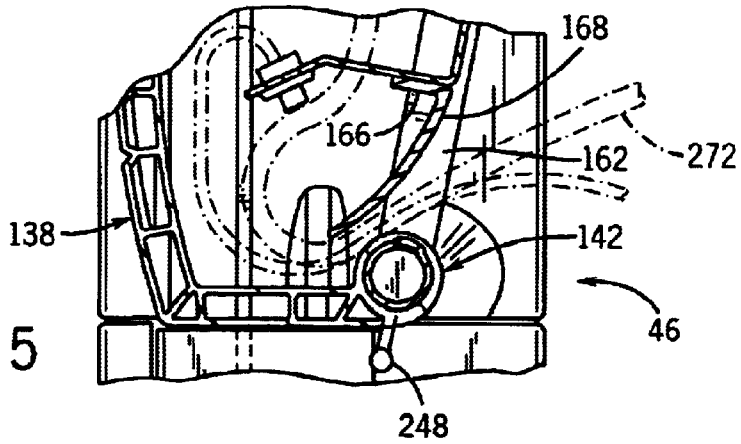
FIG. 5 is a partial section view of a lower portion of the wire management structure illustrated in FIG. 3.
Figure 4:
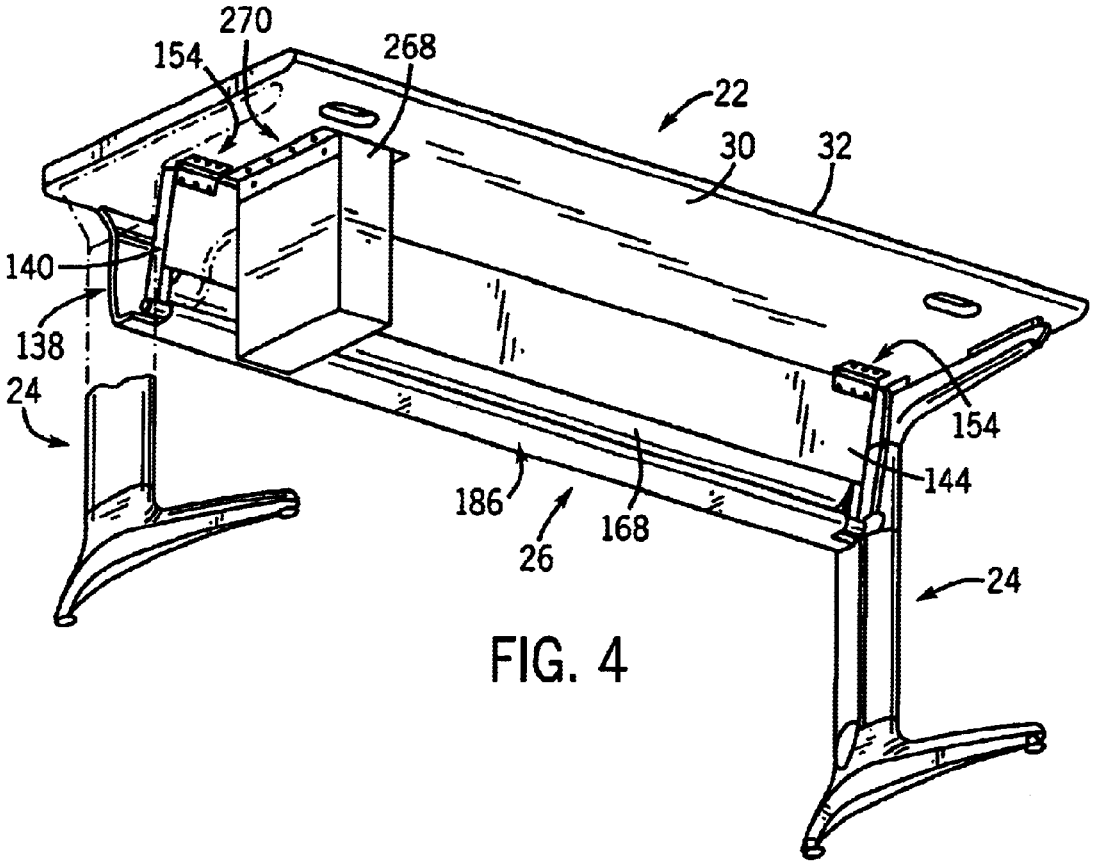
FIG. 4 is an isometric view showing the underside of the table assembly of FIG. 1.

Referring to FIGS. 4 and 5, equipment such as a CPU 268 can be supported by underside 30 of table top 22 by means of a bracket arrangement 270, in order to eliminate the need for supporting such equipment on upper surface 28 of table top 22. Wires or cables, such as 272, which extend from CPU 268 can be passed through opening 162 into the internal cavity of wire management structure 26 for engagement with a power receptacle 174 or communication jack 178, such that wires or cables such as 272 can be fed into wire management structure 26 without use of access member 138. The user passes wires or cables 272 through opening 162 by deflecting the lower end of closure flap 168 way from cross brace member 142 to create a passage into the internal cavity of wire management structure 26, and closure flap 168 forms around such wires or cables 272 to close opening 102.

FIGS. 1–11 and the above detailed description are fully set forth in U.S. patent application Ser. No. 09/322,415 filed May 28, 1999, the disclosure of which is hereby incorporated by reference.

FIGS. 12–18 illustrate a table assembly 20' constructed according to the invention, which is generally similar to table assembly 20 as shown and described previously. Where possible, like reference characters and primed reference characters will be used to facilitate clarity.

Table assembly 20' includes table top 22, mirror image foldable leg assemblies 24' and wire management housing or structure 26' located between leg assemblies 24'. Each leg assembly 24' includes an upper stationary mounting section 44' in combination with shoulder section 46, foot 48 and intermediate section 50.

Wire management structure 26' is similar in construction to wire management structure 26 as shown in FIGS. 1–11 and as described above. Wire management structure 26' includes front panel assembly 136 and access member 138, which is movable relative to front panel assembly 136 between open, closed and collapsed positions as shown in FIGS. 12–13 and 15–16, and as described above. Front panel assembly 136 includes a pair of end frame members 140', each of which defines an outer end mounted to cross brace member 142 as described above. Wall 144 extends between end frame members 140', defining an inner end 146 spaced below the underside 30 of table top 22.

Figure 14:
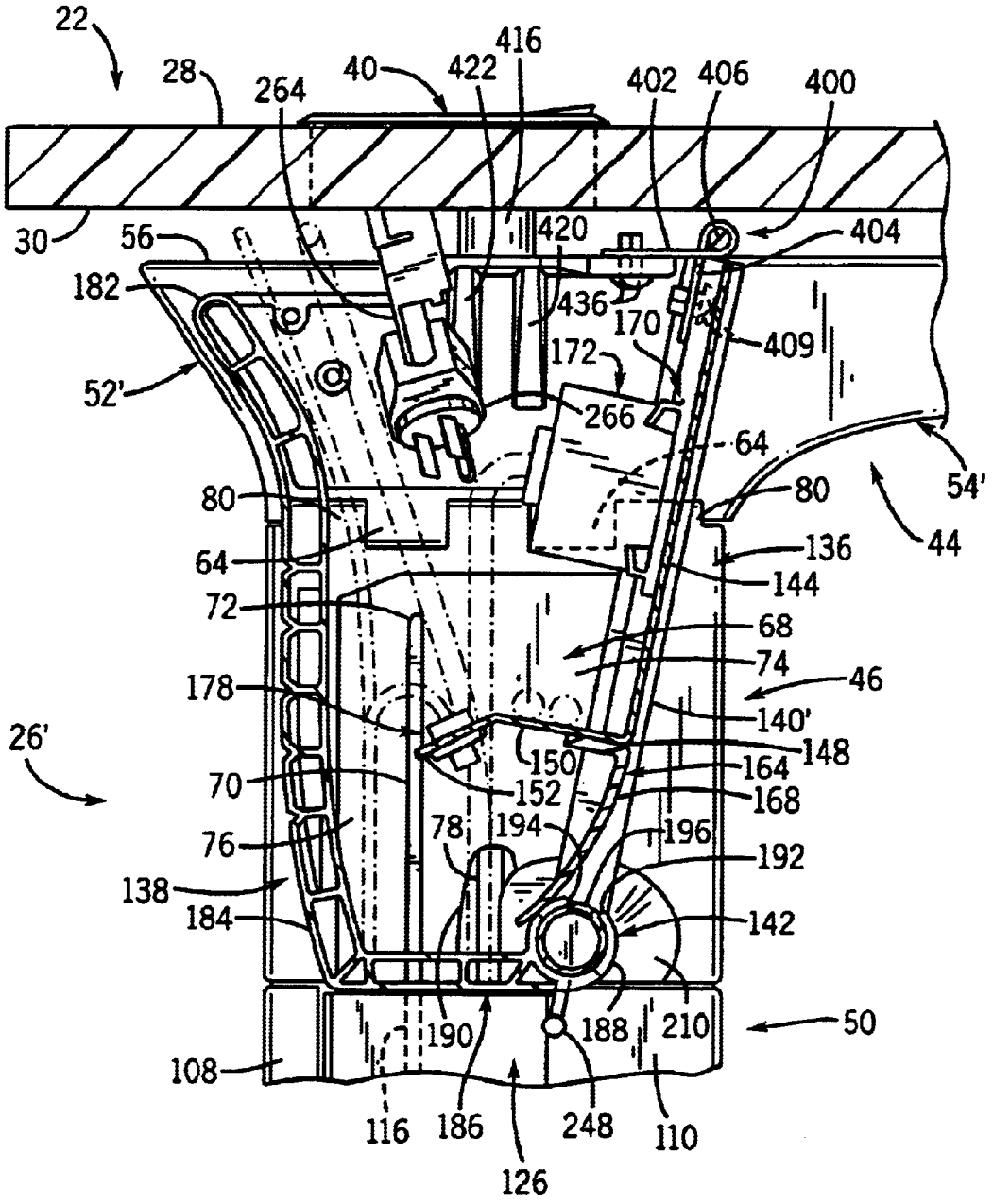
FIG. 14 is a cross-sectional view along line 14—14 of FIG. 12.
Figure 15:
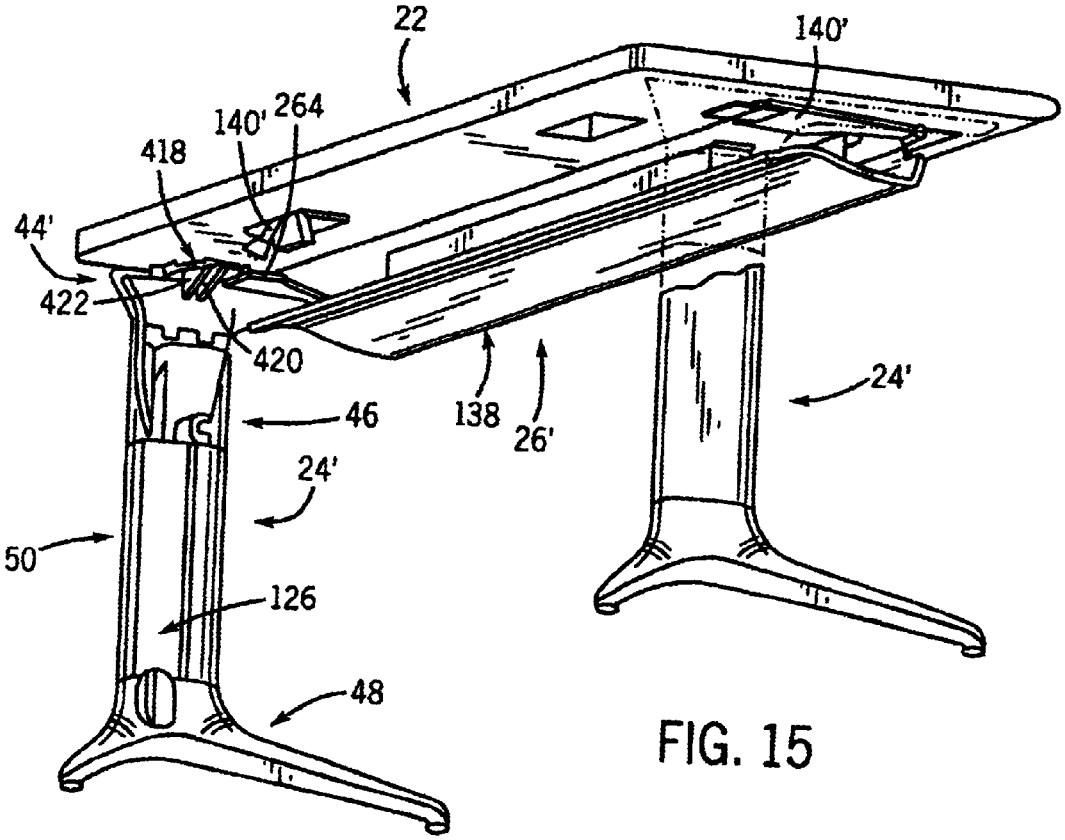
FIG. 15 is an isometric view of the underside of the table of FIG. 12, showing movement of the wire management structure to an inoperative folded position and the legs in an operative extended position.
Figure 16:
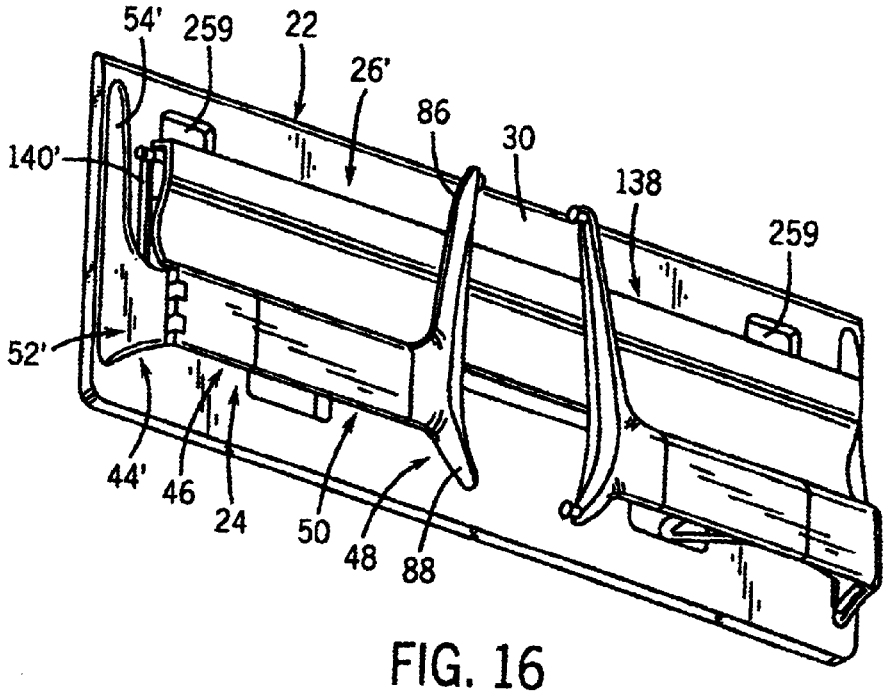
FIG. 16 is an isometric view of the table of FIG. 12, illustrating both the wire management structure and the legs in their inoperative folded positions.
Figure 17:
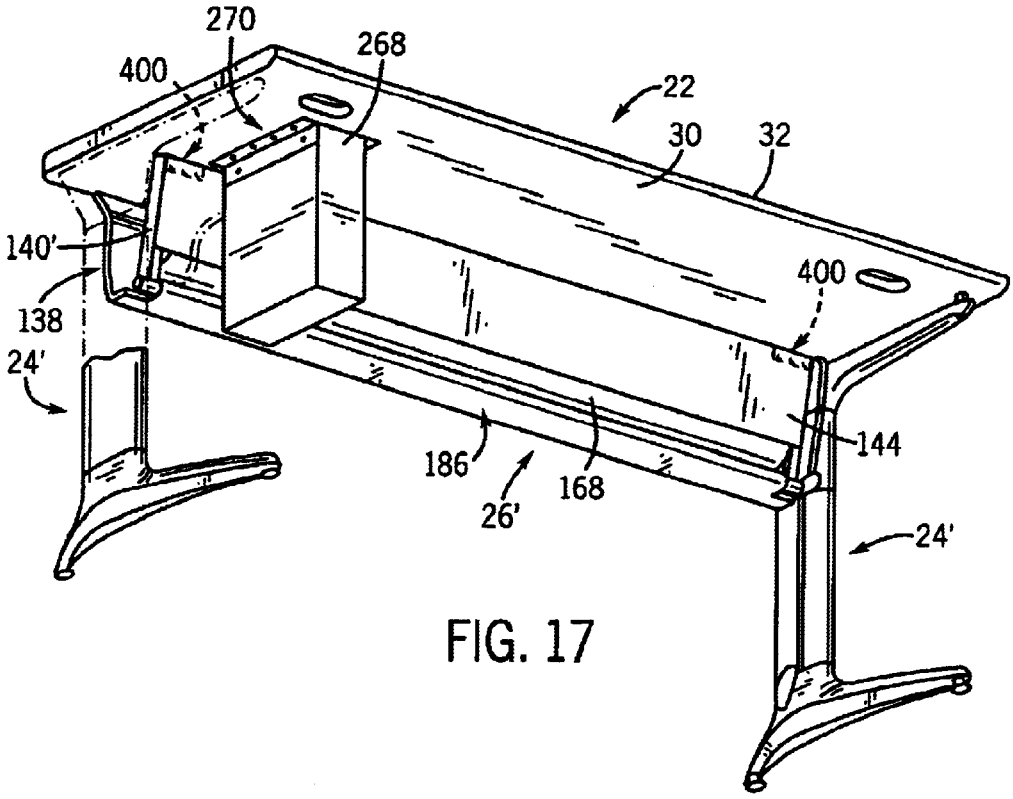
FIG. 17 is an isometric view showing the underside of the table assembly of FIG. 12.
Figure 18:
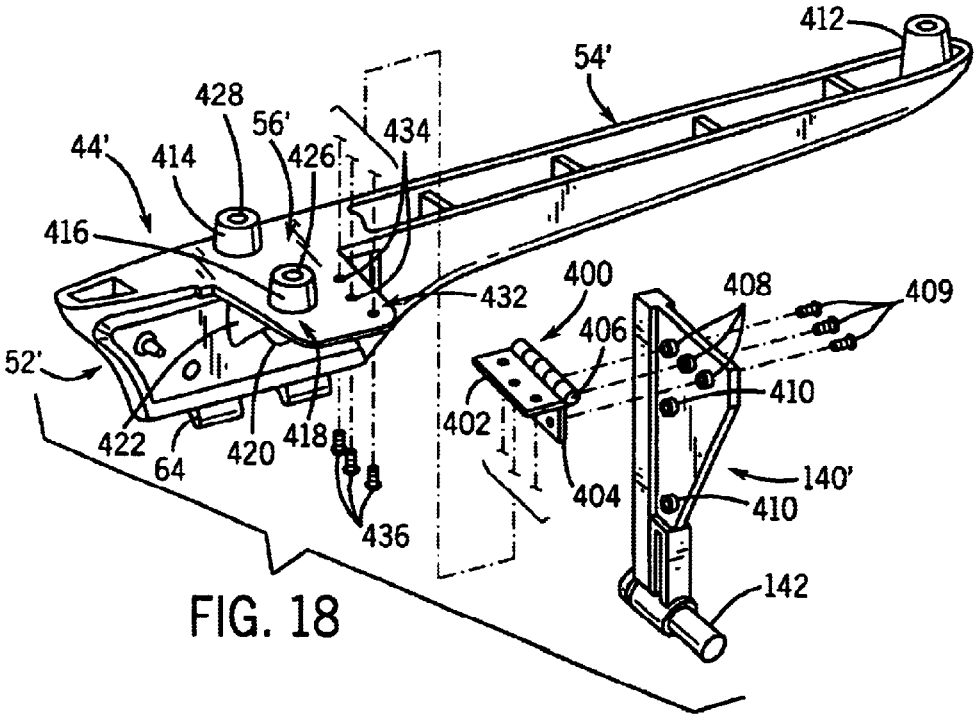
FIG. 18 is an exploded isometric view of the connection of a hinge assembly to a leg assembly and wire management structure of the table assembly of FIG. 12.

A hinge assembly 400 is interposed between each end frame member 140' and one of leg assemblies 24. As shown in FIG. 18, each hinge assembly 400 includes a stationary leaf 402 mounted to upper section 44' of one of leg assemblies 24', and a movable leaf 404 mounted to end frame member 140'. A hinge pin 406 provides pivoting movement of leaf 404 relative to leaf 402, to thereby provide pivoting movement of front panel assembly 136' relative to table top 22. As described above, front panel assembly 136' is pivotable about hinge pins 406 between an extended position, as shown in FIGS. 12 and 14, and a folded position against underside 30 of table top 22, as shown in FIG. 16.

Referring now to FIGS. 3 and 4 in table assembly 20, movable leaf 158 of each hinge assembly 124 is secured to one of end frame members 140 and stationary leaf 156 of each hinge assembly 154 is mounted to table top 22, for providing pivoting movement of wire management structure 136 relative to table top 22. In contrast, as shown in FIGS. 14 and 18, each end frame member 140' of table assembly 20' is pivotably mounted to upper mounting section 44' of one of leg assemblies 24', such that wire management structure 26' is pivotably mounted between leg assemblies 24' without support from table top 22. In this manner, leg assemblies 24' in combination with wire management structure 26' form a freestanding frame subassembly independent of table top 22. This construction provides significant advantages in strength and stability of table assembly 20'. In addition, this construction provides quick and easy removal of table top 22, in the event table top 22 requires service or replacement.

End frame members 140' of table assembly 20' have the same general construction and operation as end frame members 140 of table assembly 20, and each is operable to house one of retractable engagement assemblies 204. As shown in FIG. 18, each end frame member 140' includes a series of upper openings 408 which serve to receive fasteners 409 which secure movable leaf 404 to end frame member 140'. A pair of openings 410 are formed in each end frame member 140', and receive fasteners 409 which secure panel wall 144 to each end frame member 140'. Panel wall 144 also is secured to each end frame member 140' via the fasteners 409 which extend through openings 408 to mount movable leaf 404 of hinge assembly 400 to end frame members 140'.

Referring to FIG. 18, upper mounting section 44' of each leg assembly 24' includes a rear section 52' and a forwardly extending arm 54' which define a coplanar upper surface 56' which is spaced below underside 30 of table top 22 so as to define a gap or space 58'. Each upper mounting section 44' includes a front mounting boss 412, an outer rear mounting boss 414 and an inner rear mounting boss 416, which extends upwardly from a rigid platform 418 extending inwardly from the inner edge of upper mounting section 44', shown at 424, between rear section 52' and forwardly extending arm 54'. A pair of triangular reinforcing ribs or gussets 420, 422 extend between the underside of platform 418 and inner edge 424 of upper mounting section 44'. Mounting boss 416 defines a central passage 426 that extends downwardly through the boss 416 and through the platform 418 between ribs 420 and 422, and is adapted to receive a threaded fastener such as a screw for use in mounting table top 22 to mounting boss 416. Similarly, mounting boss 414 includes a central passage 428 that extends through boss 414 and through wall 430 from which mounting boss 414 extends so as to receive a threaded fastener such as a screw adapted to mount table top 22 to mounting boss 414.

Ribs 420, 422 are operable to rigidly support inner mounting boss 416, such that vertical forces on table top 22 are isolated from platform 418 and are experienced directly by upper mounting section 44'.

Platform 418 extends forwardly from inner mounting boss 416 and forward rib 420, to define a hinge mounting section 432 having a series of openings 434. Stationary leaf 402 of hinge assembly 400 is placed on hinge mounting section 432 such that openings in stationary leaf 402 are in alignment with openings 434 in hinge mounting section 432. Threaded connectors 436 extend through openings 434 and the openings in stationary leaf 402, for mounting hinge assembly 400 to mounting section 44'.

With this construction, wire management structure 136' is pivotably mounted to and between upper mounting sections 44' of leg assemblies 24' by means of hinge assemblies 400. Leg assemblies 24' and wire management structure 136' thus form a support subassembly independent of table top 22 by interconnection of wire management structure 136' with leg assemblies 24' rather than with table top 22.

As before, mounting section 44' of each leg assembly 24' is preferably an integrally formed cast metal member formed of a material such as aluminum, although it is understood that other satisfactory materials and forming methods may be employed. In any case, the structure of upper mounting section 44' and its interconnection with table top 22 functions to isolate wire management structure 136' and hinge assemblies 400 from table top 22 and any vertical loads applied to table top 22.

The table assembly of the invention incorporates a number of features which accommodate quick and simple movement of the components from an operative extended position to an inoperative folded position. The components provide a relatively compact folded envelope, and provide a rigid table assembly when unfolded that incorporates a number of advantageous features for accommodating wire and cable placement and supply of power and communication capabilities to the table assembly.

Various alternatives and embodiments are contemplated as being within the scope of the following claims particularly pointing out and distinctly claiming the subject matter regarded as the invention.

I claim:

1. A table assembly, comprising:

a table top;

a pair of legs mounted to the underside of the table top, wherein each leg includes an upper mounting portion rigidly secured to the underside of the table top, and a lower portion movably mounted to the upper mounting portion by means of a pivot connection providing movement of the leg between a folded position and an extended position; and a wire management structure pivotably mounted to and between the pair of legs by means of a hinge assembly interposed between each leg and the wire management structure, wherein the wire management structure is pivotably supported below the table top independent of connection to the table top.

2. The table assembly of claim 1, wherein the wire management structure is spaced below the underside of the table top.

3. The table assembly of claim 2, wherein the upper mounting portion of each leg includes at least a pair of mounting bosses extending upwardly from an upper surface spaced below the underside of the table top.

4. The table assembly of claim 2, wherein each hinge assembly includes a stationary leaf secured to the upper mounting portion of one of the legs and a movable leaf secured to the wire management structure.

5. The table assembly of claim 4, wherein the stationary leaf of each hinge assembly is secured to mounting structure defined by the upper mounting portion of one of the legs.

6. The table assembly of claim 5, wherein the mounting structure comprises a support platform extending inwardly from an edge defined by the leg upper mounting portion.

7. The table assembly of claim 6, further comprising a mounting boss extending upwardly from the mounting structure and adapted for engagement with the table top, and one or more reinforcing members extending between the mounting boss and the edge of the leg upper mounting portion, wherein the stationary leaf of the hinge assembly is secured to the mounting structure at a location spaced therefrom and wherein the hinge assembly is isolated from the connection of the table top to the mounting boss extending upwardly from the mounting section.

8. The table assembly of claim 7, wherein the mounting section comprises a platform-like member extending inwardly from an inner edge of the leg upper mounting section.

9. In a table assembly including a table top, a pair of spaced legs for supporting the table top and a wire management structure located below the table top and spaced below an underside defined by the table top, the improvement comprising a pivotable hinge connection interposed between each leg and the wire management structure, wherein the hinge connection provides movement of the wire management structure between a folded position and an extended position relative to the table top without connection of the wire management structure to the table top.

10. The improvement of claim 9, wherein the pivotable hinge connection comprises a hinge assembly secured to the wire management structure and to an upper mounting section defined by each leg, wherein each leg further includes a foldable lower section which is foldable relative to the upper mounting section.

11. The improvement of claim 10, wherein the upper mounting section of each leg includes a platform member having an upstanding mounting boss with which the table top is engaged, and a hinge mounting area spaced from the mounting boss for engagement with the pivotable hinge connection.

12. A table comprising:

a table top;

a pair of leg assemblies spaced from one another and attached to the table top, each leg assembly having an upper stationary portion secured to the table top and a lower movable portion secured to the upper portion;

a wire management structure spaced below the table top and connected between the upper portions of the pair of leg assemblies; and a pair of hinge assemblies pivotally connecting the wire management structure to the upper stationary portion of each leg assembly.

13. The table of claim 12 further comprising a pair of frame members attached to opposite sides of the wire management structure and to the pair of hinge assemblies.

14. The table of claim 12 wherein the upper stationary portions each include a mounting structure connected to the pair of hinge assemblies.

15. The table of claim 14 wherein the mounting structure is integrally formed with the upper mounting portion.

16. The table of claim 12 wherein the upper mounting portions each include at least one upwardly extending mounting boss that engages the table top.

17. The table of claim 16 wherein the at least one mounting boss is disposed on a mounting structure defined by the upper mounting portion.

18. The table of claim 17 wherein the hinge assembly is connected to the mounting structure at a location spaced from the at least one mounting boss.

19. The table of claim 18 wherein the upper mounting portion includes a first mounting boss disposed on the mounting structure and a second mounting boss spaced from the first mounting boss.

20. The table of claim 12 wherein the hinge assemblies include a stationary member connected to the upper portion and a movable member connected to the lower portion, wherein the stationary member and movable member are connected by a pivot pin.

* * * * *